United States Patent [19]

Saunders

[11] 4,020,431

[45] Apr. 26, 1977

[54] MULTIAXIS ROTARY JOINT FOR GUIDED EM WAVES

[75] Inventor: Roger A. Saunders, Cedar Rapids, Iowa

[73] Assignee: Rockwell International Corporation, El Segundo, Calif.

[22] Filed: Jan. 15, 1976

[21] Appl. No.: 649,756

[52] U.S. Cl. ..... 333/98 TN; 333/21 R; 333/33; 333/97 R

[51] Int. Cl.[2] ..... H01P 1/06; H01P 1/16; H11P 5/08

[58] Field of Search ..... 333/98 R, 98 BE, 98 TN, 333/21 R, 98 S, 96, 97 R; 339/274; 285/51, 261, 263–265; 343/757–759, 761–766, 770–772, 882

[56] References Cited

UNITED STATES PATENTS

| | | | |
|---|---|---|---|
| 2,369,849 | 2/1945 | Phillips | 285/263 X |
| 2,646,508 | 7/1953 | Fisher, Jr. | 343/761 |
| 2,667,578 | 1/1954 | Barnett et al. | 343/761 X |
| 2,753,531 | 7/1956 | Butler | 333/97 R |
| 2,955,288 | 10/1960 | Palmer | 343/882 X |
| 2,956,280 | 10/1960 | O'Keefe et al. | 343/772 |
| 2,962,677 | 11/1960 | Edwards | 333/26 X |
| 3,459,873 | 8/1969 | Harris et al. | 339/7 |

OTHER PUBLICATIONS

Harvey– "Microwave Engineering" 1963 Academic Press, London and New York; title page and pp. 126–127.

*Primary Examiner*—Paul L. Gensler
*Assistant Examiner*—Marvin Nussbaum
*Attorney, Agent, or Firm*—Terry M. Blackwood; Robert J. Crawford; L. Lee Humphries

[57] ABSTRACT

An electromagnetic wave guiding rotary joint admitting of rotary motion about two or more axes. A spherical journal and a complementary spherical race afford electromagnetic communication between two wave guiding means.

6 Claims, 7 Drawing Figures

MULTIAXIS ROTARY JOINT FOR GUIDED EM WAVES

This invention relates to electromagnetic wave guiding means and more specifically to rotary joints.

A joint which electromagnetically and mechanically couples a first electromagnetic wave guiding means (such as a waveguide or coaxial line) to a second wave guiding means and which permits rotation of the first relative to the second is generally referred to in the art as a rotary joint. A common type of rotary joint employs two substantially abutting cylindrical sections (of either circular waveguide or coaxial line) which are coaxially aligned and one of which is rotatable relative to the other about their common axis. For instance, see Pages 814–815 of the MIT Radar School Staff book entitled "Principles of Radar," Third Edition, 1952, McGraw-Hill. Also see U.S. Pat. Nos. 2,584,399 and 2,596,398. Other approaches and/or variations, such as the ring type joint of U.S. Pat. No. 2,595,186, or the right angle coax to waveguide joint of U.S. Pat. No. 2,473,443, are also known.

Such conventional joints have a common limitation; i.e., joint rotation is limited to rotation around a single axis. If rotation around two axes is required, two rotary joints are required, and so on. Of course as each joint is added, the volume or space required to allow proper relative movement of the combination of joints (i.e., the swept volume and/or basic volume) becomes greater. In applications where multiaxis rotation is required and yet equipment space is limited, the relatively large volume required by combinations of conventional joints can be a problem. One particular such application, and the one in which this invention is presently employed to alleviate the problem, is in an airborne radar system.

In accordance with the present invention, a rotary joint features multiaxis rotation about a single pivot point and requires a minimum volume for the multiaxis function.

Figure 1:
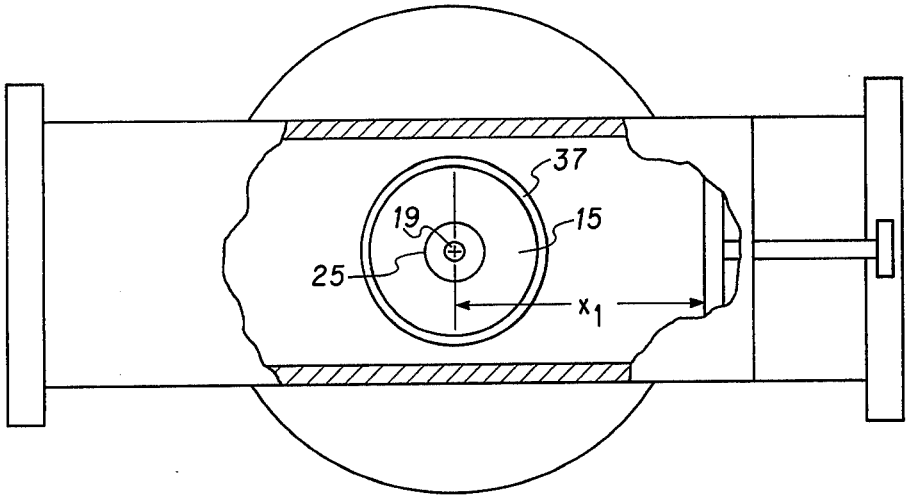
Figure 2:
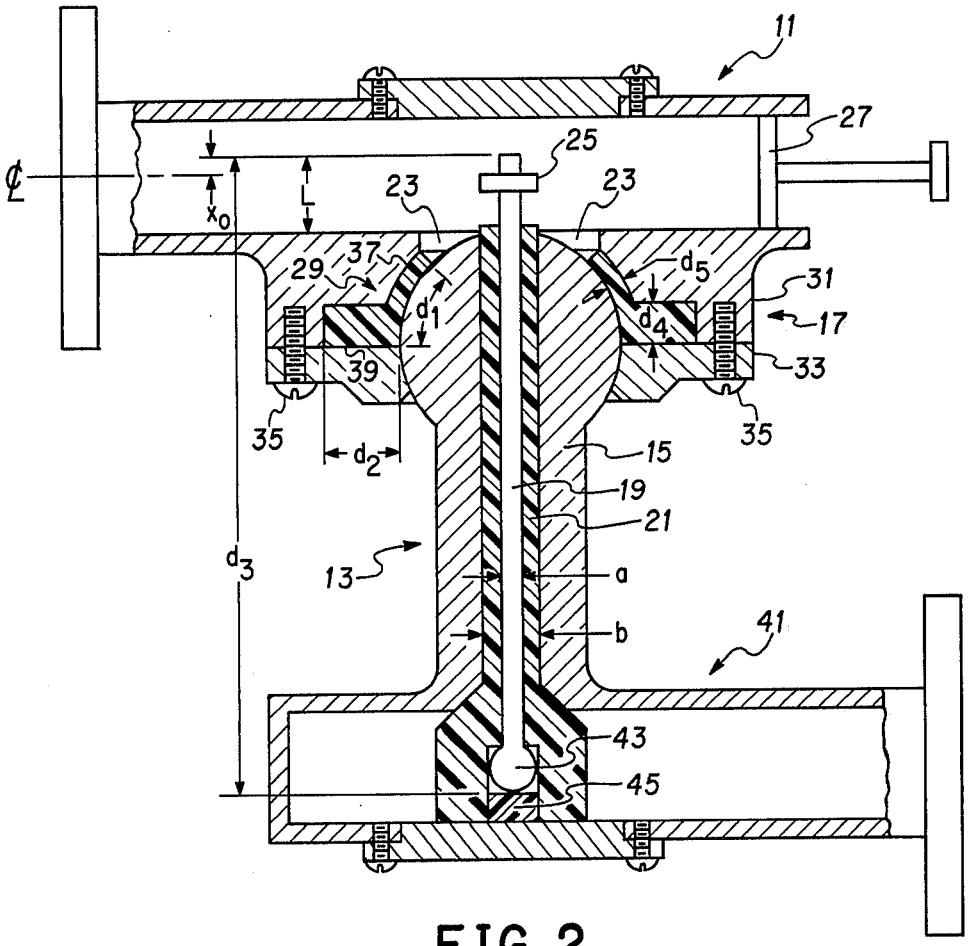
Figure 3:
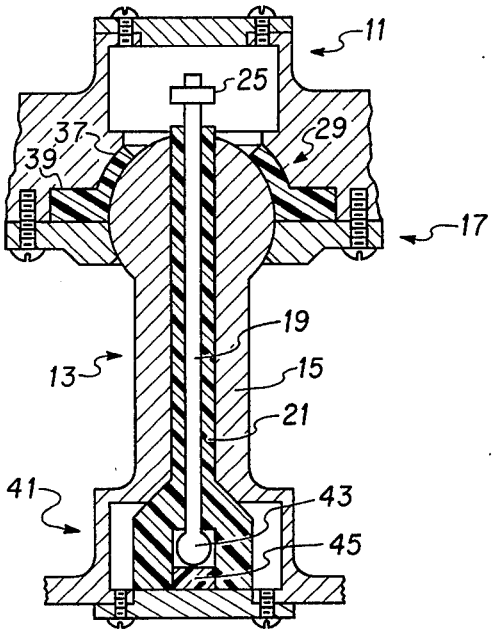
Figure 4A:
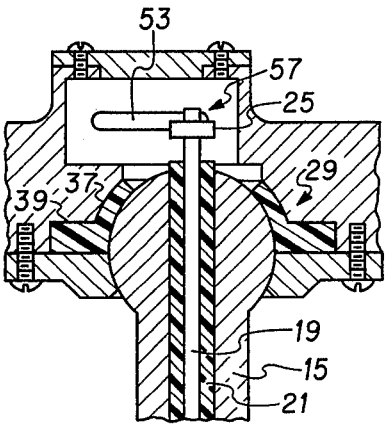
Figure 4B:
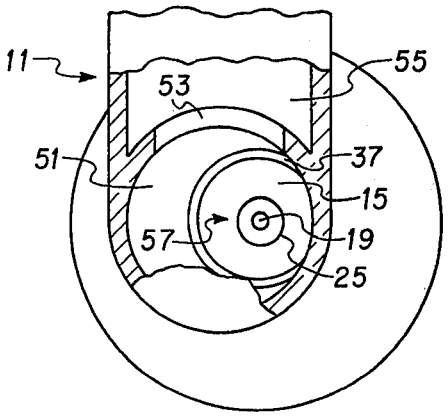
Figure 6:
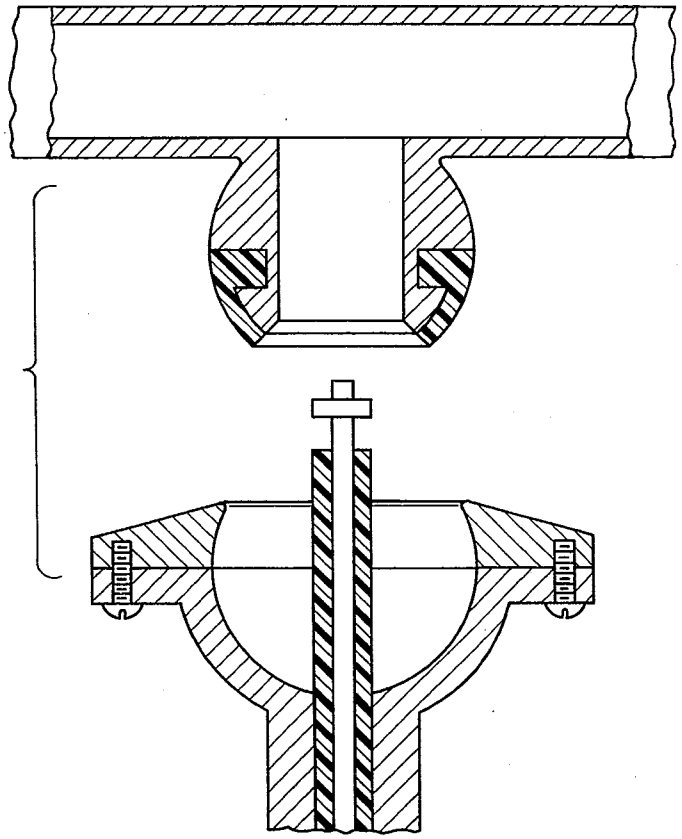
Figure 5:
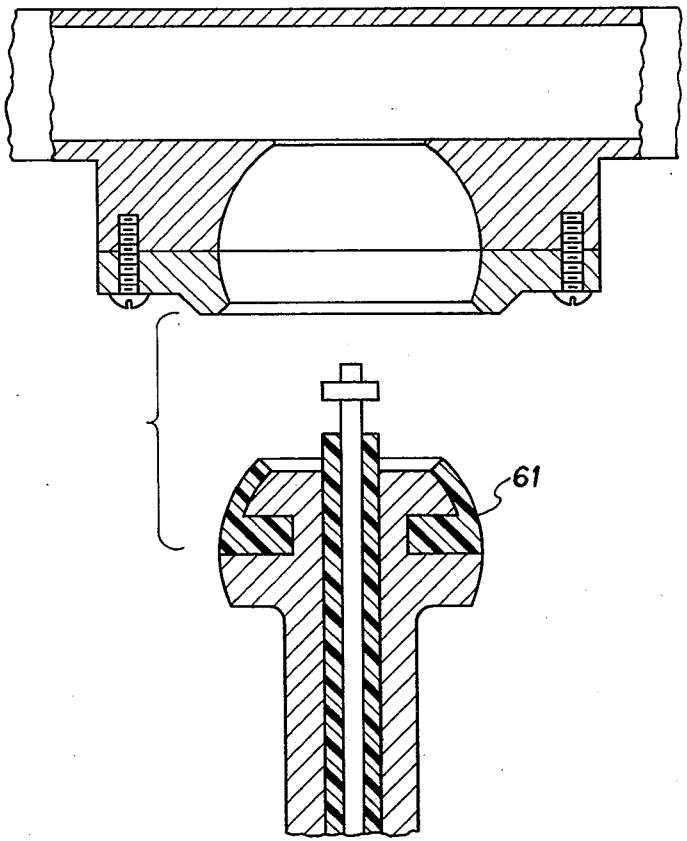

These and other features, objects and advantages of the invention will become more apparent upon reference to the following specification, claims, and appended drawings in which:

FIGS. 1, 2, and 3 are respectively top, front, and end views, each partially cut away, of the presently preferred embodiment;

FIGS. 4*a* and 4*b* are end and top views respectively, partially cut away, of a presently preferred modification of the FIGS. 1 through 3 embodiment;

FIGS. 5 and 6 are fragmentary, partially cut away and exploded, front views of alternative embodiments.

In the presently preferred embodiment illustrated in FIGS. 1 through 3, a ball-and-socket joint, providing electromagnetic continuity and admitting of rotation around two or more axes, is formed at the juncture of waveguide section 11 and coaxial line section 13. More particularly, one end of the rigid outer conductor 15 of coax section 13 is spherically configured to journal within a complementary spherical race in bearing 17 which is integral with waveguide section 11. The center conductor 19 protrudes beyond the coaxial insulator 21 and the spherical outer conductor, and bearing 17 and waveguide 11 are appropriately apertured at 23 to permit this center conductor extension to extend inside waveguide 11. This center conductor protrusion or extension thereby provides a probe-coupling type of electromagnetic wave communication between coax section 13 and waveguide section 11. Metal disc 25 is soldered to the coax extension and serves an an impedance matching element. The dimensions and placement of the metal disc can take various values dependent on application altitude requirements and magnitude and direction of rotation. Piston 27, slideable inside waveguide 11, also is a matching means accessible for final adjustment of impedance match either initially or during service.

Bearing 17 comprises a two part metal housing and a dielectric insert 29. Element 31 of the housing is, in the preferred embodiment, unitary with the lower wide side of waveguide 11. Element 33 of the housing is a cap retainer or clamp for the spherical journal portion of the joint and is demountably connected to element 31 via fasteners 35. Element 33 is split in this embodiment and is constructed using a self-lubricating material such as an oil impregnated metal. Alternatively, with item 13 demountably connectable to item 41 to allow assembly, a unitary or undivided clamp 33 may be employed.

The dielectric insert 29, being apertured at the top to complement the waveguide side aperture, and having an arcuate portion 37 and a flange portion 39, substantially resembles a right truncated hollow hemisphere from which, near the equatorial great circle thereof, depends an annular flange. With each of $d_1$ and $d_2$ in FIG. 2 approximately equal to a quarter wavelength, the arcuate portion 37 and the flange portion 39 each effectively constitute, over the frequency range of interest, substantially a quarter wavelength transmission line. These two lines are in series, and together constitute a half wavelength shorted transmission line in series with either the waveguide or coaxial line, or both at their interface, and this $\lambda/2$ shorted line minimizes electrical discontinuity between waveguide 11 and coax outer conductor 13. The actual point of sliding metal-to-metal contact is at or near a current minimum. Being at a current minimum reduces the sensitivity of the sliding joint to r.f. leakage and electrical disturbance across the joint. In the vernacular of the art, the device may be referred to as an RF choke. It should be apparent from FIG. 2 that dielectric insert 29 serves not only as an RF choke but additionally provides part of the internal bearing surface, or race, in which the spherical journal turns. Insert 29 presently is made of the low friction dielectric material, polytetrafluoroethylene. Other materials, such as plastic filled polytetrafluoroethylene or others, which have appropriate bearing properties and dielectric constant, may be employed.

Also seen from FIGS. 2 and 3, RF coupling in to or out of the lower end of coaxial section 13 is provided via waveguide section 41. More particularly, in the preferred embodiment the outer coax conductor 15 is unitary with the upper wide side of waveguide section 41, and the inner conductor 19, terminated with a spherical tip 43, extends down in to section 41 to provide probe-type coupling between waveguide section 41 and coaxial section 13. The portion of coaxial insulator 21 which extends down in to waveguide section 41, in conjunction with dielectric spacer plug 45, forms a snug housing which ensures appropriate probe positioning and overall structural integrity.

Probe embodiments other than those above described may, of course, be employed. (See Theodore Moreno's book entitled "Microwave Transmission Design Data", First Edition, 1948, McGraw-Hill, pages 176 through 178.) Whatever probe embodiment is chosen, the electrical characteristics of the probes and the coaxial line section are preferably coordinated to provide efficient conversion from waveguide mode to coax mode and back to waveguide mode. More particularly, as is well known in the art, a probe generally of the type illustrated acts as an antenna radiating down the waveguide and for efficient coupling the antenna radiation resistance R should reasonably match the coaxial line impedance $Z_0$ where $$R \quad L^2\cos^2\left(\frac{\pi x_o}{a}\right)\sin^2\left(\frac{2\pi x_1}{\lambda_g}\right)$$

$$\text{and } Z_o = \frac{138}{\sqrt{\Sigma}}\log_{10}\frac{b}{a}.$$

The parameters $\lambda_g$ and $\epsilon$ are respectively the wavelength in the guiding means and the dielectric constant of the medium 21 between center and outer conductor. The other parameters L, $x_o$, $x_1$, $a$, and $b$ are pictorially defined in FIGS. 1 and 2.

A model constructed in accordance with FIGS. 1 through 3 and the expressions for R and $Z_0$, and for use in X band at 9.3–9.4GHz, produced an insertion loss of approximately 0.5 db when tested over 360° of azimuth rotation at 0° tilt. When tested over 360° of azimuth rotation at 15° tilt, the model produced an insertion loss of 1.0 db. (Azimuth and tilt correspond to rotation, in the plane of the page, of waveguide section 11 in FIGS. 1 and 2 respectively.) Typical values employed for $Z_0$ and $\epsilon$ were approximately 50 ohms and 2.1 respectively.

To improve consistency in device electrical characteristics and to provide a flatter insertion loss characteristic whenever larger tilt angles are desired (e.g., ±30°), it has been found desirable to tailor the coupling at the rotary joint as shown in FIGS. 4*a* and 4*b*. More specifically, a cylindrical cavity 51 is provided in waveguide section 11 and a resonant iris or aperture 53 couples between the resonant cavity portion 51 and the waveguide output line 55. Probe 57 is employed to couple from the coax line into the resonant cavity and is offset from the cavity center to increase this coupling. Aperture couplings of this type are also common in the art. See the above referenced "Principles of Radar", Pages 689–696.

Certain other relationships have also been determined preferable. For instance, it is preferable that the coaxial line length ($d_3$ in FIG. 2) not be equal to any multiple of $\lambda_g$. If $d_3$ is close to a multiple of $\lambda_g$, insufficient bandwidth may be obtained. Additionally, to reduce loss and provide increased bandwidth, the thickness of choke flange 39 ($d_4$ in FIG. 2) should be several times greater than the thickness of the arcuate portion 37 ($d_5$ in FIG. 2).

From the foregoing, various modifications will be apparent to those skilled in the art. For instance, for applications where circular waveguide modes are not objectionable, an appropriate circular waveguide section may be substituted for coaxial section 13. Also, it is not essential that the choke insert be incorporated in the bearing portion 17 as described and shown in FIS. 1 through 4*b*. As seen in FIG. 5, an appropriate choke 61 may be incorporated in the journal portion. Moreover, the journal and bearing need not be integral respectively with the coax section and the waveguide section. See FIG. 6, where the mechanical roles of the waveguide and coax are reversed from the FIGS. 1 through 4*b* embodiments. Further exemplary, these individual modifications may be combined to yield other modifications.

Thus, while various embodiments of the present invention have been shown and described, it is apparent that changes and modifications may be made therein without departing from the invention in its broader aspects. The aim of the appended claims, therefore, is to cover all such changes and modifications as fall within the true spirit and scope of the invention.

What is claimed is:

1. An electromagnetic wave guiding rotary joint comprising:

a coaxial line section whose outer conductor at one end is rigid and spherically configured to form a spherical journal, and whose inner conductor at the same end extends beyond the outer conductor a predetermined length, a waveguide section having an aperture in one side, a bearing member having a spherical race complementary with said spherical journal of said coaxial section, said bearing member being connected to said waveguide section and having an aperture in appropriate alignment with said waveguide side aperture, said bearing receiving said spherical journal such that the inner conductor extension protrudes into said waveguide and provides electromagnetic wave communication between said waveguide section and said coaxial section, said bearing and journal cooperating to form a joint capable of rotation about two or more axes, said bearing member comprising a metal housing and a dielectric material, said dielectric material forming at least a part of said spherical race and further, to constitute an RF choke within a predetermined frequency range, being configured to act as substantially a half wavelength shorted transmission line wherein the actual point of sliding metal to metal contact is at or near a current minimum.

2. A joint as defined in claim 1 wherein said dielectric material is configured substantially as a right truncated hollow hemisphere having, near its equatorial great circle, a depending annular flange, the arcuate portion and the flange portion together having an effective length of substantially a half wavelength.

3. A joint as defined in claim 2 wherein said dielectric material comprises a low friction dielectric material.

4. For guiding electromagnetic waves, a joint admitting of rotary motion about two or more axes comprising:

a spherical journal integral with a first means for the guided transmission of electromagnetic waves, a bearing having a complementary spherical race for receiving said journal, said bearing being integral with a second means for the guided transmission of electromagnetic waves, a substantially half wavelength, shorted line, RF choke incorporated in a predetermined one of said journal or bearing, said journal and bearing permitting electromagnetic wave communication between said first guide means and said second guide means and cooperating to form a multiaxis rotary joint.

5. A joint as defined in claim 4 wherein said choke comprises a dielectric material partially spherically configured to provide at least a portion of the spherical surface of said predetermined one of said journal or bearing.

6. A joint as defined in claim 5 wherein said dielectric material comprises a low friction dielectric material.

* * * * *